US007549476B2

(12) United States Patent
Carlsen et al.

(10) Patent No.: US 7,549,476 B2
(45) Date of Patent: Jun. 23, 2009

(54) SUBSEA WIRELINE LUBRICATOR

(75) Inventors: Hans-Paul Carlsen, Notodden (NO); Olav Inderberg, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 18 days.

(21) Appl. No.: 10/558,662

(22) PCT Filed: May 27, 2004

(86) PCT No.: PCT/NO2004/000154

§ 371 (c)(1),
(2), (4) Date: Dec. 21, 2006

(87) PCT Pub. No.: WO2004/106695

PCT Pub. Date: Dec. 9, 2004

(65) Prior Publication Data

US 2007/0119595 A1 May 31, 2007

(30) Foreign Application Priority Data

May 28, 2003 (NO) ..... 20032457

(51) Int. Cl.
*E21B 33/035* (2006.01)

(52) U.S. Cl. ..... 166/344; 166/88.1; 166/84.1

(58) Field of Classification Search ..... 166/344, 166/77.1, 77.2, 84.4, 88.1, 84.1
See application file for complete search history.

(56) References Cited

U.S. PATENT DOCUMENTS

| | | | | |
|---|---|---|---|---|
| 2,943,682 | A | 7/1960 | Ingram, Jr. et al. | |
| 3,638,722 | A | 2/1972 | Talley, Jr. | |
| 4,825,953 | A | 5/1989 | Wong et al. | |
| 4,938,290 | A | 7/1990 | Leggett et al. | |
| 4,993,492 | A | 2/1991 | Cressey et al. | |
| 5,863,022 | A | 1/1999 | Van Winkle | |
| 6,328,111 | B1 * | 12/2001 | Bearden et al. | 166/381 |
| 6,394,460 | B1 | 5/2002 | Leggett et al. | |
| RE39,509 | E * | 3/2007 | Helms et al. | 166/385 |
| 7,331,393 | B1 * | 2/2008 | Hoel | 166/336 |
| 2003/0098161 | A1 | 5/2003 | Boyd | |
| 2004/0113108 | A1 * | 6/2004 | Ward | 251/1.3 |

FOREIGN PATENT DOCUMENTS

| | | |
|---|---|---|
| GB | 2 214 954 A | 9/1989 |
| GB | 2 233 365 A | 1/1991 |
| WO | WO 01/25593 A1 | 4/2001 |

* cited by examiner

*Primary Examiner*—William P Neuder

(57) ABSTRACT

The present invention concerns a pressure containment device for use in a lubricator. The device includes a housing having a first main bore extending throughout its length a number of transversal bores intersecting the main bore. Pairs of opposing rams are located in the transversal bores to grip and seal around a cable in the main bore.

12 Claims, 2 Drawing Sheets

SUBSEA WIRELINE LUBRICATOR

FIELD OF THE INVENTION

The present invention relates to a pressure control device. More particularly the invention relates to a compact pressure control device for use in a subsea lubricator stack.

BACKGROUND OF THE INVENTION

When developing subsea oil and gas wells there are stringent demands to the control and containment of the well during all aspects of the work, be it drilling, production or later intervention. The needs for control of well pressure have lead to requirements for safe barriers in the well and/or above ground, both during production and during intervention work.

During the lifetime of the well various types of work may be carried out to enhance production or to measure conditions in the well. Well intervention may be difficult, as existing barriers have to be removed to gain entry into the well. There are in most countries strict rules regarding the size and number of barriers needed to keep control of the well during intervention. To gain access to a living well a blowout preventer, containing a number of valves, must be connected to the well before the well barriers can be opened. In addition, a number of pressure containment devices ensure control over the well during the work.

One of the methods for gaining entry into a live well is by using a lubricator. This employs a tool attached to the end of a wire or cable and inserted into the well. This equipment includes means whereby grease can be injected under pressure to seal around and lubricate the wire or cable during rising or lowering of the tool, hence the name lubricator.

Lubricators are in use both on surface and on subsea wells. U.S. Pat. No. 4,993,492 shows an example of a surface lubricator, while U.S. Pat. No. 3,638,722 and International Patent Application no. WO 0125593 shows examples of subsea lubricators. In for example WO 0125593 there is shown a subsea lubricator consisting of the afore-mentioned blowout preventer, called a Lower Intervention Package (LIP), a tool housing (or lubricator pipe), and a pressure control head which includes a grease injector assembly. When lowering a tool into the well using this equipment, the wire or cable is inserted through the pressure control head and the tool attached to the end of the wire. Then the whole assembly is lowered to the seabed and the tool guided into the tool housing while the LIP valves and Christmas tree valves are closed. Then the grease injector is closed around the wire above the tool. The LIP valves and Christmas tree master valve can now be opened so that the tool can be lowered into the well.

The tool housing must be of a length capable of holding the full length of the tool, and this can be up to 30 meters. The whole lubricator assembly may be up to 50 meters long.

To ensure a greater degree of safety, an additional blow out preventer is mounted on top of the tool housing. One common type of blow out preventer includes a shear/blind ram in combination with one or two wireline rams. The shear ram is used to cut the wire or cable in an emergency. As described in U.S. Pat. No. 4,938,2909, the wireline ram(s) are designed to grip and hold the wire and include facilities for grease injection. The main disadvantage with these is their large size and weight. The weight, mounted on top of up to a 30 meters column, exerts a large bending moment on the lubricator and necessitates a stronger (and therefore heavier) tool housing and connectors.

A stuffing box is also normally included in a lubricator assembly above the grease injector. The stuffing box is intended to grip and hold the wire or cable in the event of gas leaking past the grease injector. Examples of known stuffing boxes are shown in UK Patent No. GB 2,214,954 and U.S. Pat. No. 2,943,682. In Pat. No. U.S. Pat. No. 5,863,022, a stripper/packer having a split bonnet is shown. The packer also serves as a blowout preventer. The packer can be axially activated to achieve a radial sealing, and the function of the packer is similar to a stuffing box. The present invention can be used together with a packer of this type.

To reduce some of the the weight the lubricator described in WO 0125593 uses only a shear/blind ram in conjunction with a second high pressure stuffing box with grease injection, the stuffing box being a replacement for the wireline ram. However, a stuffing box in this position will have well pressure acting on the lower surface of its rubber cylinder, thereby adding to the forces keeping the rubber in compression. There are also higher frictional forces. This makes it difficult to control the stuffing box properly. One consequence has been that it has proved difficult to reopen the stuffing box, forcing the operator to cut the wire and retrieve the whole lubricator to the surface. This can be a costly operation.

In U.S. Pat. No. 6,394,460, a one-piece ram element block for wireline blowout preventers is shown. The ram element block is a part of a BOP housing having a generally vertically oriented bore for a wireline. The BOP housing defines a pair of opposed ram element bores wherein linearly movable ram elements are located. Here, high pressure grease is injected into the flow passage between the upper and lower ram elements, thereby effecting a proper wireline seal when the rams are actuated to their closed positions. The ram elements are not located in separate bores and can not be independently controlled.

An object of the present invention is therefore to produce a pressure containment device in place of the stuffing box which can be positively and exactly balanced and will give a better control over the gripping forces than existing stuffing boxes. As the shear/blind ram function is also built into the device it will eliminate the need for the upper blowout preventer. It is small and compact and will therefore reduce the overall bending moments on the lubricator. This in turn makes it possible to reduce the strength and size of the tool housing and connectors.

The present invention utilises positively closing and opening rams to grip and hold the cable or wire. It also includes a shear/blind ram so that it will cut the wire or cable in a emergency. Because the unit is located in the pressure control head, e.g. above the tool housing, the internal size can be related to the wire diameter and not, as in the present, the tool diameter.

SUMMARY OF THE INVENTION

The invention thus provides a pressure containment device comprising a main housing, a first longitudinal through bore arranged to receive a wire or cable slidingly therethrough, at least two spaced apart transversal through bores intersecting the main bore, and a pair of opposing rams in each transversal bore.

The bore of the ram is preferably lined with a cylindrical sleeve, enabling several sizes of wire to be used by only changing the sleeves.

The invention will now be explained in connection with a preferred, non-limiting embodiment, with reference to the drawings.

DESCRIPTION OF THE PREFERRED EMBODIMENT

Figure 1:
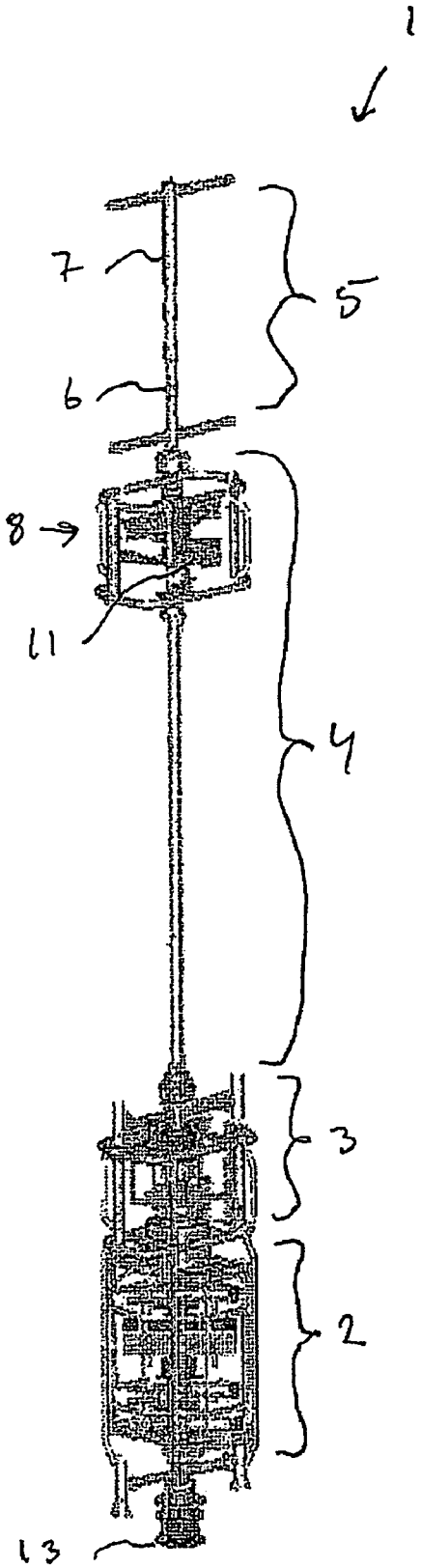
FIG. 1 is an illustration of a prior art lubricator.

A prior art type subsea lubricator 1 is shown in FIG. 1. This lubricator consists of a blowout preventer 2, or Lower Intervention Package (LIP). Attached to the LIP is an Emergency Disconnect Package (EQDP) 3. A lubricator tool housing 4 is connected to the EQDP. The tool housing is in the form of a pipe of a length that will contain a tool before lowering it into the well. A pressure control head 5 is connected to the tool housing. The pressure control head includes grease injectors 6, a line wiper 7, and a stuffing box (not shown). An upper blowout preventer 8 is located on top of the tool housing 4.

When used on a surface well, the EQDP is omitted.

Figure 2:
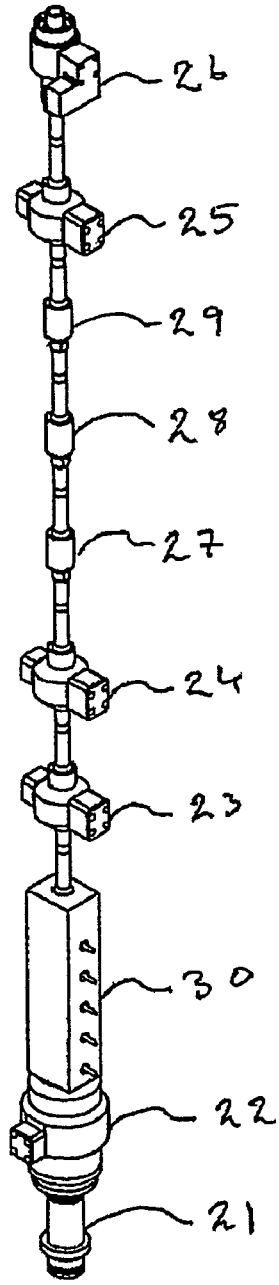
FIG. 2 is an illustration of the lubricator of the present invention shown in a pressure control head assembly.

FIG. 2 shows the pressure control head assembly according to the invention. The pressure control head assembly comprises, from bottom to top, a connector 21 for coupling to the tool housing, a tool catcher unit 22, a pressure containment device 30 (that will be described in more detail later), first 23 and second 24 grease inlets, a grease return 25 and a combined upper stuffing box and line wiper 26. The numerals 27-29 depict grease tubes. The upper stuffing box and line wiper 26 can, as an example, be of the type shown in U.S. Pat. No. 5,863,022.

During intervention work, the pressure control head assembly acts as the primary seal barrier preventing hydrocarbons from escaping into the environment. Grease is injected under pressure through inlets 23 and 24, travels up along grease tubes 27-29, sealing and lubricating the wire, and is returned through grease outlet 25. The stuffing box 26 is only used when there is a need to clamp and hold the wire securely, as can happen if hydrocarbons leak past the grease tubes 27-29. The tool catcher unit 22 holds the tool as it is raised and lowered between the surface and the seabed.

The pressure containment device 30 according to the invention is shown to comprise a solid housing 31, in the form of a rectangular solid metal block. The housing may have coupling parts such as flanges (not shown) at each end for connecting the housing with the rest of the pressure control head assembly. A main bore 32 extends through the length of the housing. When assembled into the pressure control head assembly, the main bore is aligned with the bore above and below to provide a fluid path through the lubricator.

Figure 3:
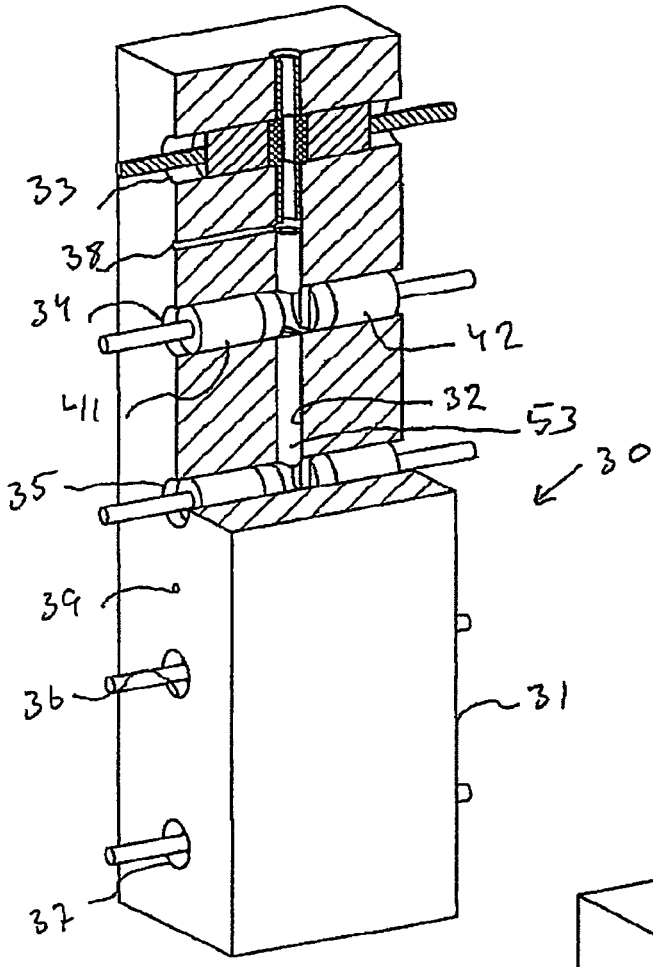
FIG. 3 is a partial cross sectional view of the pressure containment device of the invention.

Auxiliary bores 33, 34, 35, 36 and 37 extend transversally through the housing 31 and intersect the main bore 32. As shown, bores 33-37 may be located in the same vertical plane as the axis of main bore 32. Grease supply bores 38 and 39, which are also located in the same plane as the axis of the main bore 32, extend from the side but end in ports (only port 40 is shown) in main bore 32. As seen in FIG. 3, bore 38 is located between bores 33 and 34 while bore 39 is located between bores 35 and 36.

As an alternative, the bores 33-39 can be staggered around the sides of main housing 31. For example, each bore can be located perpendicular to the next bore, or the bores can be distributed in a stepped fashion relative to each other.

Figure 4:
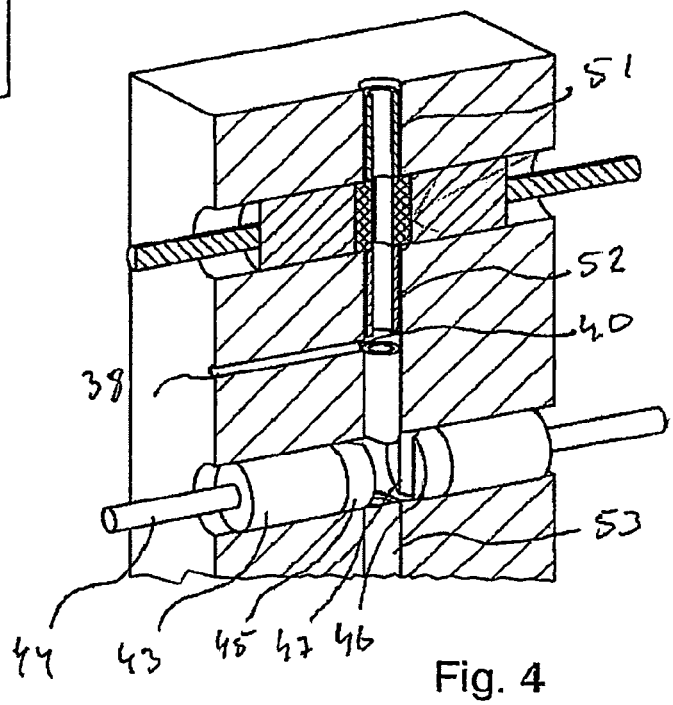
FIG. 4 is an enlarged view of the pressure containment device of FIG. 3.

In each bore 33-36 a pair of opposing rams 41, 42 are arranged to move towards each other as is well known. As shown in FIG. 4, ram consists of a main cylindrical part 43 that forms a sliding fit within its bore. A rod 44 is attached to cylindrical part 43 and is intended to be connected to an actuator (not shown) that can be bolted onto the housing. A cylindrical body 45 of an elastic material such as rubber is fixed to the front of main cylindrical part 43. Rubber body 45 preferably has an outer diameter which is sized to enable it to seal against its bore. Rubber body 45 has a front surface 46 with a vertical slot 47. When the two rams 41, 42 are in their fully closed position, surfaces 46 will abut and seal against each other except for the slots 47, which will define a circular opening for the passage of the wire or cable.

A conventional shear/blind ram for cutting wire or cable is located in bore 37. Bores 38, 39 are connected to a pump (not shown) for supplying grease under pressure to main bore.

Main bore 32 has an inner sleeve lining, which comprises. a number of smaller sleeves. Upper sleeve 51 extends from the top of housing 31 to first ram bore 33. First intermediate sleeve 52 extends between first 33 and second 34 ram bores. As shown in FIG. 4, sleeve 52 may be in two parts which are separated by a gap 54 located in the area of grease injection bore 38, or alternatively may have a port oriented in line with grease injection bore 38. Second intermediate sleeve 53 extends between second 34 and third 35 ram bores. A third intermediate sleeve (not shown) extends between ram bores 35 and 36 and is identical to sleeve 52, while a fourth intermediate sleeve (not shown) extends between ram bores 36 and 37 and is identical to sleeve 53. A lower sleeve (not shown) is identical to upper sleeve 51.

Each sleeve forms a sliding fit within main bore 32, that is, the sleeves are positioned in bore 32 with a very small clearance. When mounted, each sleeve is oriented in the correct angular position and fixed in place, for example, with screws or latches. Moreover, each sleeve has an inner diameter corresponding to the outer diameter of the wire or cable so that the wire or cable has a small clearance within the sleeves.

The sleeves have two functions. They are exchangeable and can therefore be sized to fit the size of the wire or cable in use to obtain the desired tight fit. Therefore, when using another size cable or wire, the sleeves can easily and quickly be exchanged with sleeves tailored to the wire or cable size. The sleeves will also prevent the rubber on the rams from extruding into main bore 32 when subjected to pressure as grease is pumped into main bore 32.

The rams 33-35, and the shear rams 36 and 37, are actuated by means of controllable actuating means (not shown). The actuating means are preferably hydraulically or mechanically driven, and the force exerted by the controllable actuating means on the rams is controllable. Moreover, the force from the controllable actuating means can be controlled independently for each of the rams. A detecting device, such as a gas detector, television camera etc, is preferably used to detect the conditions in the well. The controllable actuating means can be controlled based on the detected condition.

In use, rams 33-35 will be actuated to close around the wire or cable to hold it securely. At the same time, grease is injected through grease injection ports 38, 39 by means of grease injection means to seal between the wire and the sleeve. The grease injection means controls the pressure of the injected grease.

If necessary, shear ram 37 will be activated to shear off wire, allowing the main valve in the LIP and the Christmas tree master valve to be closed.

The use of rams allow for a precise control of the tightness around the wire. If so desired, the rams can be positioned with slightly reduced pressure to allow the wire to be drawn through the rams while maintaining control over grease pressure. This allows the tool to be moved to a safer location, for example into the tool housing while still maintaining control of the well. The continuous injection of grease under high pressure makes it possible to control and contain the well pressure.

In an emergency the shear ram will be activated to cut the wire or cable. This will cause the tool to fall into the well and allow the lubricator to be disconnected and removed.

The invention claimed is:

1. A pressure containment device comprising:

a housing;

a first bore which extends generally longitudinally through the housing and is arranged to receive a wire or cable slidingly therethrough;

at least second and third spaced apart bores which extend generally transversely through the housing and intersect the first bore;

a pair of opposing rams which are positioned in each of the second and third bores; and a sleeve lining which is removably positioned in the first bore and through which the wire or cable extends, the sleeve lining comprising an inner diameter which corresponds to the outer diameter of the wire or cable.

2. The device according to claim 1, further comprising a fourth bore which is located between the second and third bores and which extends into the first bore.

3. The device according to claim 2, wherein the sleeve lining comprises a first sleeve which is positioned between the second and third bores.

4. The device according to claim 3, wherein the first sleeve extends between the second and fourth bores and the sleeve lining further comprises a second sleeve which extends between the third and fourth bores.

5. The device according to claim 3, wherein the first sleeve comprises a port which is aligned with the fourth bore.

6. The device according to claim 1, wherein each ram comprises a front part which is constructed of an elastic material.

7. The device according to claim 6, wherein the front part includes a slot for the wire or cable.

8. The device according to claim 1, wherein each ram comprises a front part which includes a knife for cutting the wire or cable.

9. The device according to claim 1, wherein the sleeve lining comprises a number of individual sleeves.

10. A subsea lubricator comprising:

a blowout preventer;

a tool housing; and a grease injector assembly which comprises a pressure containment device that includes;

a housing;

a longitudinal bore which extends through the housing and is arranged to receive a wire or cable slidingly therethrough;

a first transversal bore which extends through the housing and intersects the longitudinal bore;

a first pair of rams which are positioned in the first transversal bore;

a second transversal bore which extends through the housing and intersects the longitudinal bore;

a second pair of rams which are positioned in the second transversal bore; and a grease supply bore which extends through the housing between the first and second transversal bores and which intersects the longitudinal bore;

a sleeve lining which is removably positioned in the longitudinal bore and through which the wire or cable extends;

wherein the sleeve lining comprises a number of individual sleeves, including a first sleeve which is positioned between the first and second transversal bores; and a third transversal bore which intersects the longitudinal bore and is located between the first and second transversal bores.

11. The subsea lubricator according to claim 10, wherein the first sleeve extends between the first and third transversal bores and the sleeve lining further comprises a second sleeve which extends between the second and third transversal bores.

12. The subsea lubricator according to claim 10, wherein the first sleeve comprises a port which is aligned with the third transversal bore.

* * * * *